United States Patent [19]

Dörling

[11] 4,225,122

[45] Sep. 30, 1980

[54] DEVICE FOR COOLING PLATE COOLERS OF BLAST FURNACES

[75] Inventor: Rolf Dörling, Gummersbach, Fed. Rep. of Germany

[73] Assignee: L. & C. Steinmüller GmbH, Gummersbach, Fed. Rep. of Germany

[21] Appl. No.: 893,774

[22] Filed: Apr. 5, 1978

[30] Foreign Application Priority Data

Apr. 6, 1977 [DE] Fed. Rep. of Germany ..... 2715390

[51] Int. Cl.[3] ..... C21B 7/10

[52] U.S. Cl. ..... 266/193; 266/46

[58] Field of Search ..... 266/46, 193, 194

[56] References Cited

U.S. PATENT DOCUMENTS

| | | | |
|---|---|---|---|
| 3,652,070 | 3/1972 | Sagara | 266/193 |
| 4,033,561 | 7/1977 | Dhelft | 266/193 |
| 4,061,317 | 12/1977 | Andoniev et al. | 266/193 |
| 4,071,230 | 1/1978 | Zherdev et al. | 266/193 |

FOREIGN PATENT DOCUMENTS

| | | | |
|---|---|---|---|
| 48-26564 | 8/1973 | Japan | 266/193 |

*Primary Examiner*—John McQuade

*Attorney, Agent, or Firm*—Becker & Becker, Inc.

[57] ABSTRACT

A device for cooling, by means of liquid media, plate coolers of blast furnaces and the like which plate coolers include cooling pipes of cast segments, according to which the cooling medium at different operating or working pressures is passed through the cooling pipes of the cast segments.

2 Claims, 3 Drawing Figures

DEVICE FOR COOLING PLATE COOLERS OF BLAST FURNACES

The present invention relates to a device for cooling plates by means of liquid media plate coolers of blast furnaces or the like. The plate coolers are provided with cooling pipes and formed of cast segments.

Plate coolers are used where, container walls are subjected to high temperatures. For purposes of lowering these temperatures at the surface adjacent to the heat radiation, the individual segments which are made of cast iron are internally provided with pipes through which the cooling medium or coolant, for instance water, flows. The cooling medium or coolant absorbs heat and so lowers the temperature of the wall surface of the segment. The effectiveness of the cooling depends essentially on the passage of heat as far as the inner surface of the cooling pipe or tube. This passage of heat is determined by the heat conduction in the plate cooler and in the tube wall as well as the gap between tube and plate cooler. In the known plate coolers this gap is caused by the manufacturing tolerances of the plate cooler recess as well as of the cooling tube. This gap is necessary for the tube mounting or with cast tubes it is formed by the different shrinkage behavior during the cooling off of the plate cooler and the pipe.

It is known so to cool lining segments of cast iron or steel with cast-in cooling tubes, so-called cooling plates, for instance as a stack wall in blast furnaces, with a cooling media, a coolant for instance water, flowing through the cooling tubes so that the temperatures of that surface of the individual plate coolers located on the furnace side are limited. Heretofore, these coolers have been operated without pressure by natural circulation. Thus, with a given geometry and heating surface loading in a stationary state, an equilibrium occurs in which the circulation force resulting from the difference in density between the gravity tube or down-tube side through which there is single-phase flow and the plate cooler side through which there is two-phase flow is in equilibrium with the flow losses. Corresponding to this single stable operating is a surface temperature which necessarily develops. The mode of operation of the container or container part bounded by the plate coolers, for example a blast-furnace stack, may make it necessary to achieve different temperatures of the surface. This could not be achieved heretofore with the known plate coolers with natural circulation coolers for a constant thermal stress.

Furthermore, in plate coolers made of cast iron, it is known to cast the cooling pipes integrate when casting the plate coolers.

Now if a tube inside a plate cooler is damaged or destroyed for instance by erosion or corrosion, the entire segment must be replaced and scrapped because the tubes in the known plate coolers can not be dismounted and so the cooling element can not be repaired.

The object of the present invention is to achieve different plate cooling surface temperatures and to ensure a satisfactory heat transfer from the plate cooler and the cooling tube, a simple dismounting of individual plate coolers being assured.

These and other objects and advantages of the invention will appear more clearly from the following specification in connection with the accompanying drawings, in which:

FIG. 1 diagrammatically illustrates the arrangement of various plate coolers constructed in the form of individual segments as the outer wall of a blast furnace.

According to the invention, in that the cooling medium is conveyed through the cooling tubes of the cast iron segments under different pressure.

For improving the heat transfer between the segment constructed in the form of a plate cooler, and the cooling tube it is further proposed according to the invention that a heat-conducting mass should be disposed between the cooling and the aperture in the segments that receives them.

Furthermore, it is proposed, according to the invention, that for more rapid dismounting in the event of repairs, the cooling tubes should be replaceably disposed in the individual segments, while the segment has a partial continuous aperture which has a stopper at one end and rings in the region of the passage of the tube sockets.

For purposes of obtaining a satisfactory heat transfer, the invention is furthermore characterized in that the cooling tubes are constructed in the form of finned pipes.

If the pressure is altered in an advantageous manner in such a circulation system, for example increased, then the boiling temperature of the coolant also alters according to the course of the particular vapor pressure curve. For example, for water it increases from about 110° C. at 1.4 bar to about 230° C. at 30 bar. With a constant heat, the temperature of the surface shifts in the same order of magnitude.

Figure 1:
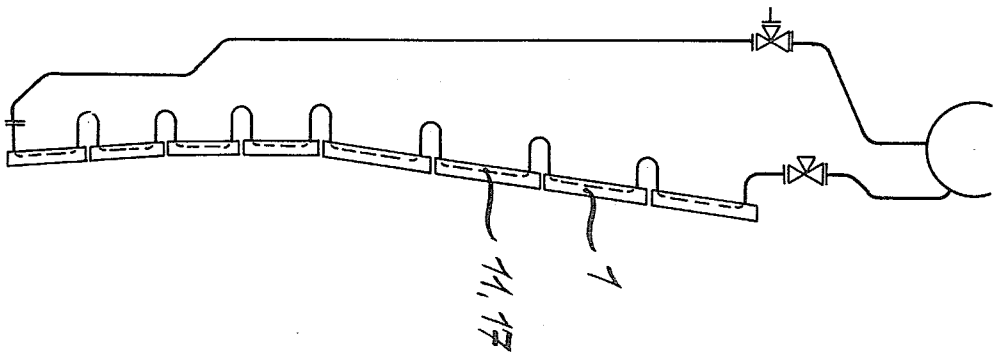
Figure 2:
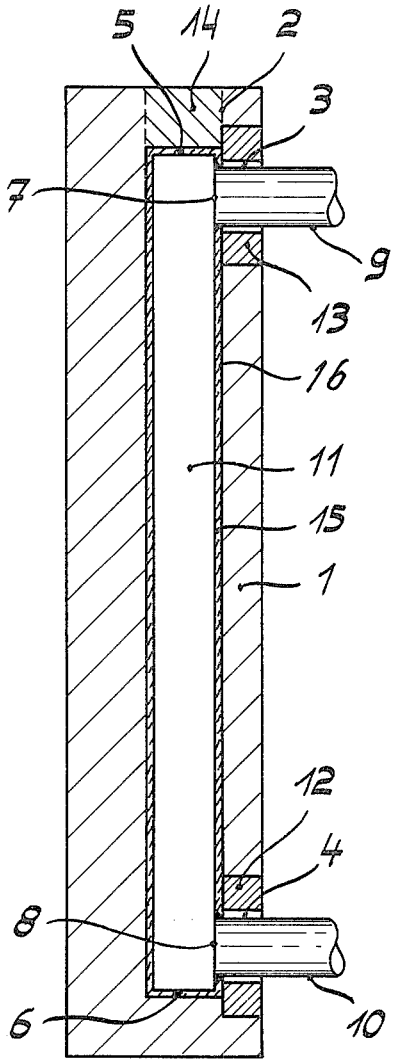
FIG. 2 is a section through an individual plate cooler with a removable smooth cooling tube.

Referring now to the drawings in detail, the plate cooler 1 is provided with apertures or openings 2, 3 and 4. A pipe or tube 11, which is closed by discs 5 and 6, is inserted through the aperture 2 so that apertures 7 and 8 provided in the length of tube or pipe section are situated in front of the apertures 3 and 4. Lengths of tube or pipe sections 9 and 10 are respectively inserted through these apertures and are welded to the tube 11. The plate cooler is then closed in a suitable manner by rings 12 and 13 and a stopper 14. A replacement of the tube is possible in reverse sequence. In the gap 15 between the wall of the plate cooler 1 and the tube 11 there is a mass which is a good heat conductor and which is introduced in plastic state and then fills in the gap 16 when hardened (FIG. 2). As such heat conducting mass, a synthetic material sold under the name DEVCON and produced by the DEVCON Corporation, Denver, Massachusetts, may be used; also liquified lead may be utilized for this purpose.

Figure 3:
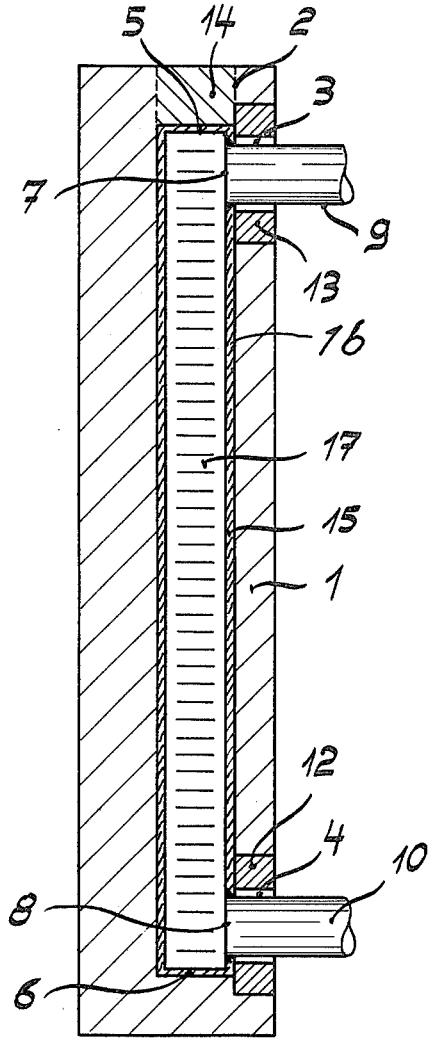
FIG. 3 represents an embodiment similar to FIG. 2 but with a finned tube forming the cooling tube.

FIG. 3 shows the arrangement of a finned tube 17.

As a result of the fact that the circulation system is so designed that it can be operated at different pressures, the possibility advantageously results in being able to vary the surface temperature of the plate cooler.

A further advantage of the present invention consists in that individual coolant tubes in individual segments can be dismounted at any time without the entire plate cooler system having to be renewed.

A very important advantage consists in a better heat transfer between the cooler and the cooling tube.

It is, of course, to be understood that the present invention is, by no means, limited to the specific showing in the drawings, but also comprises any modifications within the scope of the appended claims.

What I claim is:

1. A plate cooler comprising a cast segment provided with a cooling pipe exchangeably arranged in said segment, said segment being provided with a first bore housing said pipe and with additional bores transverse to and communicating with said first bore, pipe connecting means respectively passing through said additional bores and connected to said cooling pipe for conveying a cooling fluid into and out of said pipe, means closing both ends of said first bore, and ring means surrounding said pipe connecting means where the latter pass through said additional bores.

2. A combination according to claim 1, in which said cooling pipe is provided with cooling fins.

* * * * *